US009439485B2

(12) United States Patent
McGarry

(10) Patent No.: US 9,439,485 B2
(45) Date of Patent: Sep. 13, 2016

(54) GALLERY PENDANT

(71) Applicant: Susan McGarry, Fairfield, CA (US)

(72) Inventor: Susan McGarry, Fairfield, CA (US)

( * ) Notice: Subject to any disclaimer, the term of this patent is extended or adjusted under 35 U.S.C. 154(b) by 195 days.

(21) Appl. No.: 14/266,725

(22) Filed: Apr. 30, 2014

(65) Prior Publication Data

US 2015/0000336 A1 Jan. 1, 2015

Related U.S. Application Data

(60) Provisional application No. 61/841,604, filed on Jul. 1, 2013.

(51) Int. Cl.
*A44C 25/00* (2006.01)

(52) U.S. Cl.
CPC ..... *A44C 25/002* (2013.01)

(58) Field of Classification Search
CPC .. A44C 25/00; A44C 25/001; A44C 25/002; A44C 15/003
USPC ..... 63/1.14, 18, 21–23, 40
See application file for complete search history.

(56) References Cited

FOREIGN PATENT DOCUMENTS

FR 2726162 A1 * 5/1996 ..... A44C 25/002

* cited by examiner

*Primary Examiner* — Abigail Morrell
(74) *Attorney, Agent, or Firm* — David E. Newhouse, Esq.

(57) ABSTRACT

A gallery pendant is described for displaying art and craft articles including jewels, gems, cabochons, paper, drawings, leather, metal, and images that can be secured within an open face, open top box by a detachable face frame and a cord or chain received through ear loops through the sides of the box proximate the open top of the box.

18 Claims, 4 Drawing Sheets

GALLERY PENDANT

RELATED APPLICATIONS

This Application claims all benefits applicable under 35 U.S.C. §119(e) related to U.S. Provisional Patent Application Ser. No. 61/841,604 filed by the Applicant on 1 Jul. 2013 entitled "GALLERY PENDANT", and incorporates U.S. Provisional Patent Application Ser. No. 61/841,604, in its entirety, by reference into this application.

BACKGROUND OF THE INVENTION

1. Field of the Invention

The present invention relates generally to pendants for interchangeably displaying art and craft articles including jewels, gems, cabochons, paper, drawings, leather, metal, and images.

2. Description of the Prior Art

Wearable items such as pendants, pins, clasps rings, bracelets and the like for interchangeably displaying art and craft articles typically include an interconnecting means attached to the various articles sought to be displayed that fastens onto and/or mates with a securing structure of the wearable item [See U.S. Pat. No. 389,778, O. Thie et al (18 Sep. 1888) and U.S. Pat. No. 8,434,327 J. Babyak, (7 May 2013). See also U.S. Class 63 (Jewelry), Subclass 40 (Changeable ornamental element) & Subclass 29.1 (Detachable gem setting).]

SUMMARY OF THE INVENTION

A gallery pendant is described for displaying art and craft articles including jewels, gems, cabochons, paper, drawings, leather, metal, and images that can be secured within an open face, open top box by a detachable face frame and a cord or chain received through ear loops through the sides of the box proximate the open top of the box.

DESCRIPTION OF PREFERRED AND EXEMPLARY EMBODIMENTS

Figure 1:
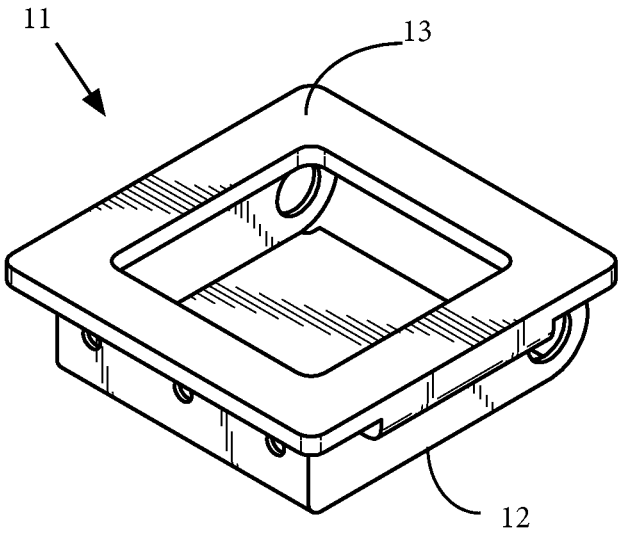
FIG. 1 is a front perspective view of the gallery pendant.
Figure 2:
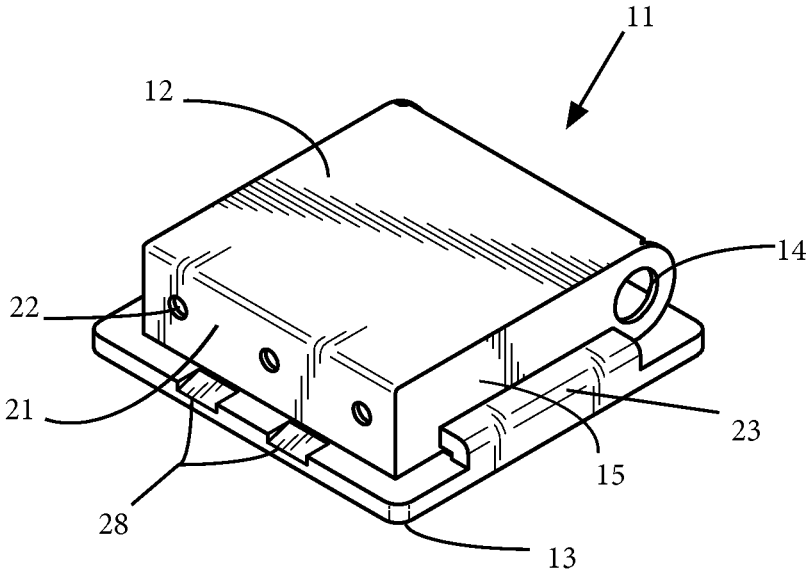
FIG. 2 is back perspective view of the gallery pendant.
Figure 3:
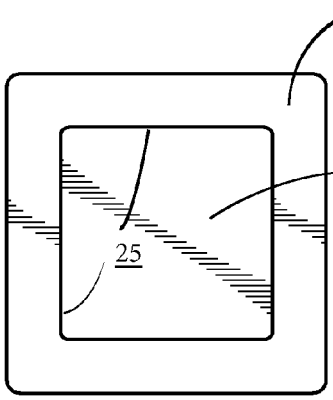
FIG. 3 is a front elevation view of the gallery pendant.
Figure 4:
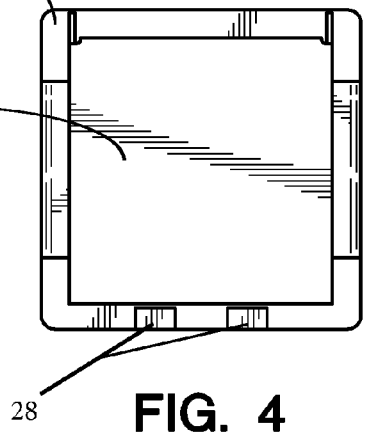
FIG. 4 is a back elevation view of the gallery pendant.
Figure 5:
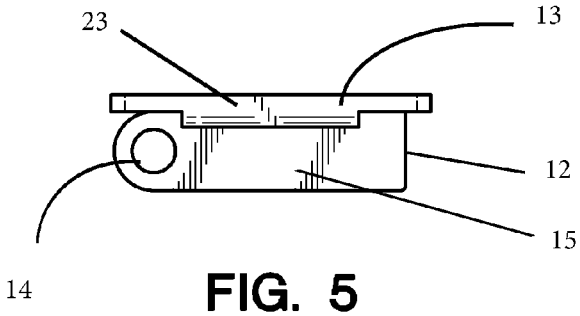
FIG. 5 is a left side elevation view of the gallery pendant.
Figure 6:
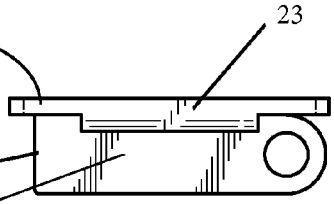
FIG. 6 is a right side elevation view of the gallery pendant.
Figure 7:
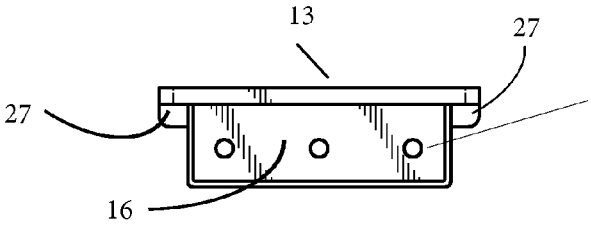
FIG. 7 is a top side elevation view of the gallery pendant.

Referring to FIGS. 1-10, the gallery pendant 11 comprises an open face, open top, hexahedral box 12 and a detachable rectangular face frame 13 with ear loops 14 through the box sides 15 at the open top 16 (FIG. 10) of the box. Integral side flanges 17 (FIG. 9) extend perpendicularly outward from central sections of the opposite the edges 18 of the box sides 15. A spaced pair of integral latch tabs 19 (FIG. 9) extend up from the open face edge of the bottom side 12 of the box 21. As shown, the bottom side 21 of the box can optionally have small diameter dangle pin holes 22 for allowing suspension of decorative dangles (not shown) from the bottom of the pendant.

As illustrated in FIGS. 3-9 the rectangular detachable face frame 13 is dimensionally larger than the open face of the hexahedral box 12, and frames a rectangular display opening 25 dimensionally smaller than the open face of the hexahedral box. Parallel shoulders 23 integrally extending up from central sections of the back surface 24 of the face frame 13 providing opposing flange channels 26 (See FIG. 9) opening inward, sized and spaced for easily receiving the flanges 17 extending out from the edges 18 of the box 12. The top ends 27 of the flange channels 26 are closed (see FIG. 7) limiting downward translation of the face frame 13 relative to the box 12

Figure 8:
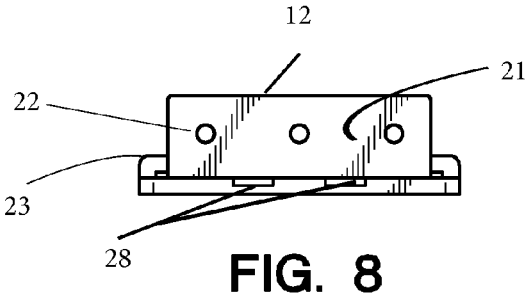
FIG. 8 is a bottom side elevation view of the gallery pendant.
Figure 9:
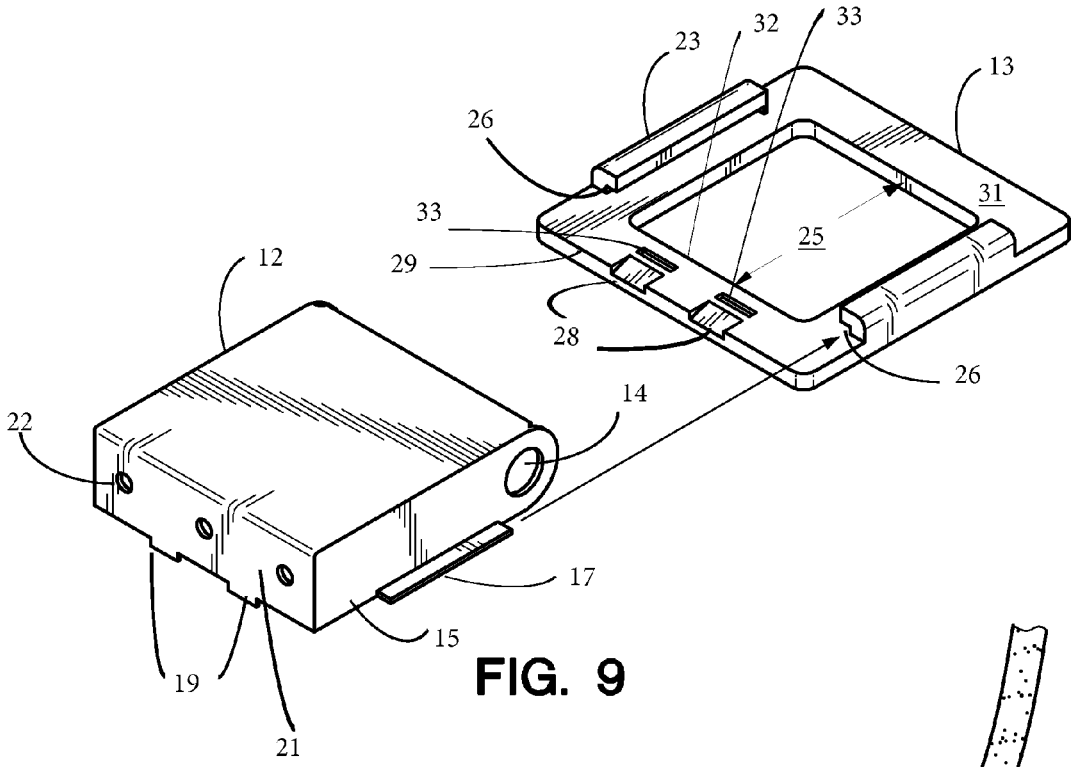
FIG. 9 is an exploded perspective view illustrating details of the interconnection of the open face, open top box and the detachable face frame of the gallery pendant.

Looking at FIGS. 8 & 9, a pair of inclined ramps 28 that extend up from the bottom side edge 29 of the bottom frame member 32 of the detachable face frame 13 onto its back surface 31. The ramps 28 are spaced and sized for registering with, and engaging the pair latch tabs 19 that extend out from the top of the bottom side 21 of the box 12. Latch recesses 33 penetrate into the back surface 31 of the bottom frame member 32 of the face frame 13 proximate the end of the ramps 28.

As illustrated in FIG. 9, the gallery pendant 11 is assembled by placing the open face, open top, hexahedral box 12 and detachable rectangular face frame 13, open face down, on the back surface 24 of the side members of the face frame 13 and sliding its side flanges 17 upward into the flange channels 26 on the face frame 13 to a point where the latch tabs 19 on bottom edge 20 of the box 12 engage the ramps 28. The box 12 is then forced upward, sliding the latch tabs 16 up the ramp inclines onto the back surface 31 of the bottom member 32 of the face frame 13, elastically lifting the bottom member of the face frame to a point where the latch tabs 16 slide onto the surface of the fame member and snap into the latch recesses 33. A display article 34 can then be dropped into of the hexahedral box 12 of the gallery pendant through its open top 16.

Figure 10:
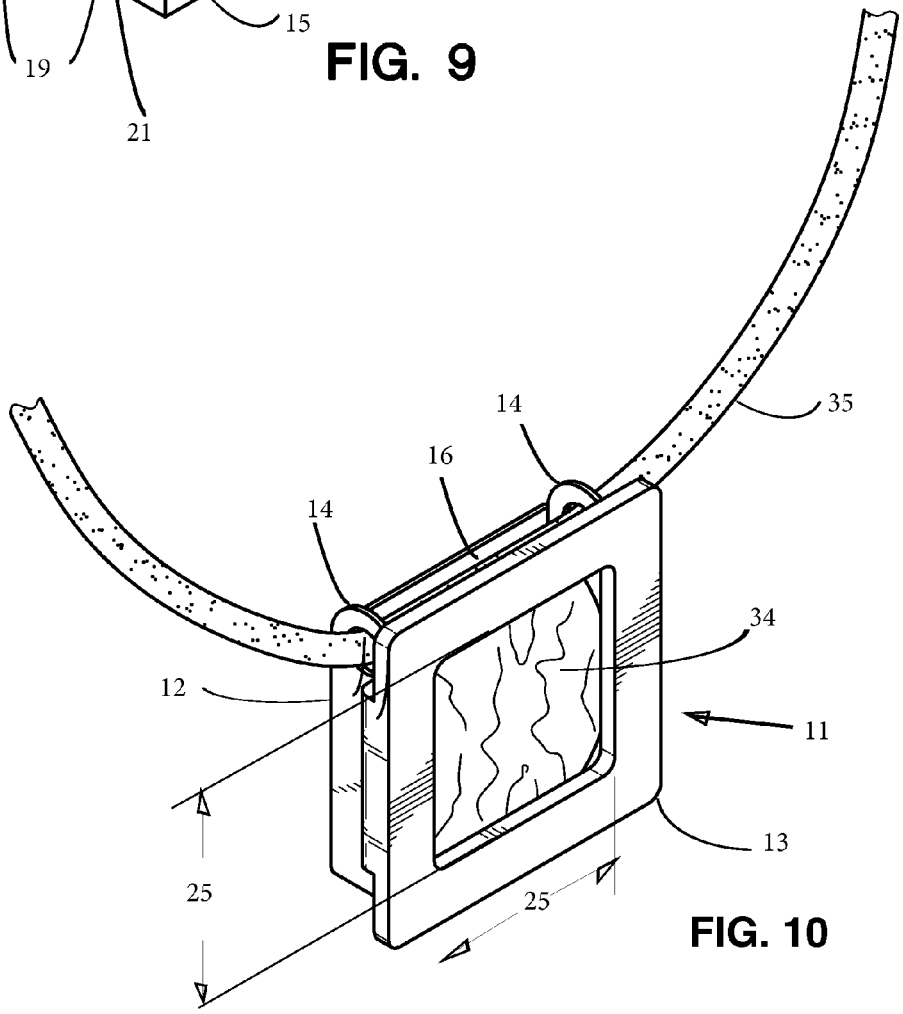
FIG. 10 is a front perspective view of the gallery pendant with an article secured for display within the open face, open top box by a detachable face frame and a cord or chain threading ear loops through the sides of the box at the top open of the box.
Figure 11:
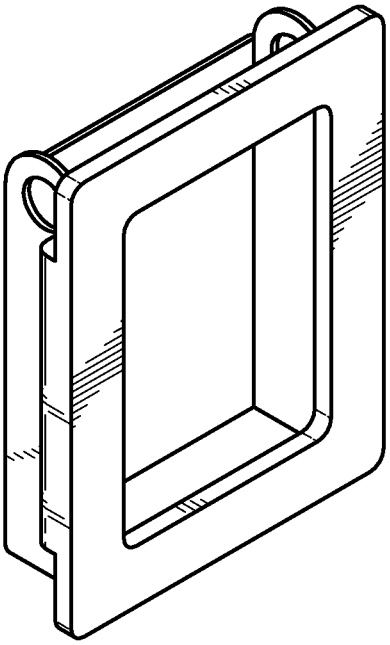
FIG. 11 is a front perspective view of the gallery pendant having a detachable face frame with a rectangular display opening.
Figure 12:
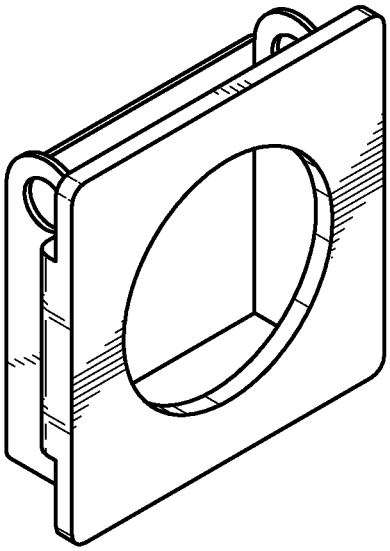
FIG. 12 is a front perspective view of the gallery pendant having a detachable face frame with a circular display opening.
Figure 13:
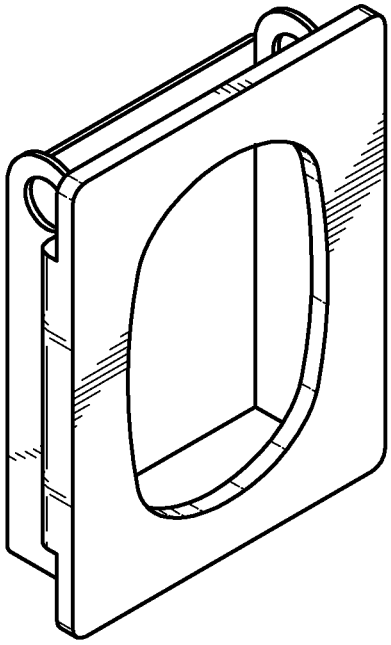
FIG. 13 is a front perspective view of the gallery pendant having a detachable face frame with an oval display opening.

As illustrated in FIG. 10, a cord or chain 35 for suspending the gallery pendant 11 is then threaded through the ear loops 14 at the open top 16 of the box 12. The suspending cord or chain 35 and the face frame 13 framing the display opening 22 confine the displayed article 34 to the space inside the hexahedral box 12.

To detach the face frame 13 from the open face, open top, hexahedral box, the display article 34 should be removed from the box 12 though the open top 16, or if it is robust it may remain in the box. In either case, the latch tabs 19 extending from the bottom edge of the open face box 12 are lifted out of the latch recesses 33 by simultaneously pressing the bottom end of the box 12 down and oppositely lifting the face frame 13, and then sliding the box downward relative to the face frame 13 disengaging the side flanges 17 of the box from the shoulder flange channels 26 of the face frame.

Obviously, as illustrated in FIG. 10, the dimensions of hexahedral box 12 and the display opening 25 of any particular gallery pendant set limits on the maximum and minimum sizes of articles 34 that can be interchangeably displayed. In particular, the articles must be small enough to fit in the volume defined by the box 12, yet larger than the display opening 25 defined by the particular face frame 13.

Also, as evident from comparison FIGS. 10 & 12, and 11 & 13, a particular open face, open top hexahedral box of a particular gallery pendant may have a several different detachable face frames each providing a display opening of a different size or shape. In fact, both the face frame and display opening of the face frame may present artistic expression complimenting or contrasting with that of a displayed article held within the hexahedral volume of the gallery pendant. However configured, the detachable face frame 13 should have:

(i) A display opening 25 dimensionally smaller than the open face of the hexahedral box 12;

(ii) Parallel shoulders 23 that extend up from central sections on opposite sides of the back surface the face frame for providing flange channels 26 sized and spaced for receiving the oppositely extending, side flanges 17 of the open face hexahedral box 12;

(iii) At least one, preferably a pair of latch tabs 19 extending up from the open face edge of the bottom side 21 of the hexahedral box 12;

(iv) Latch recesses 33 in the back surface at the bottom of fame for receiving the latch tabs 19 extending from the open face edge of the bottom side 21 of the hexahedral box 12; and (v) a parallel pair of ramp inclines 28 extending up from the outside bottom side edge 29 of the face frame 13 onto the back surface 31 of the face frame spaced for accommodating the latch tabs 19 of the open face hexahedral box 12.

The top of the face frame 13 should vertically extend above the open top 16 of the underlying hexahedral box 12 of the particular gallery pendant for confining the displayed article to the volume of the box.

The display opening 25 of the face frame13 may also be (i) a lattice presenting curvilinear, and/or rectilinear openings, (ii) a regular array of differently shaped small curvilinear and/or rectilinear openings or (iii) an irregular array of differently shaped small curvilinear and/or rectilinear openings.

The display opening 25 of the face frame13 may also be (i) a lattice of smaller curvilinear, and/or rectilinear openings, (ii) a regular array of differently shaped small curvilinear and/or rectilinear openings or (iii) an irregular array of differently shaped small curvilinear and/or rectilinear openings.

Finally, a particular face frame 13 can be interchangeable used for providing a display opening 25 for open top, open face hexahedral boxes 12 of different depths that have the same geometrical open face. In fact, a set of face fames 13, with different display openings can be sized for a set of open top hexahedral boxes12 that have the same geometrical open face but different depths.

The open face, open top hexahedral box and detachable face frame of the gallery pendant are formed from fairly rigid, resilient materials, preferable non-toxic metals such as Zinc, or metal alloys that can be, but are not easily, plastically deformed. In particular, while the open face, open hexahedral box should be a rigid structure, the face frame should composed of a material that elastically bows but does not plastically deform the bottom frame of the detachable face frame as the latch tabs of the open face box extending out from the open bottom edge of the box, slide up the incline ramps 28 onto the surface of the fame member 13 and 'snap' into the latch recesses 33. Significant effort should be required for lifting the latch tabs 19 from the anchoring latch recesses 33 in the back of the face frame 13. Zinc casting alloys are stronger than reinforced molded polymers and have hardness, self lubricating properties, dimensional stability and elasticity modulus properties suitable for working mechanical parts, such as tabs and pinions, that would be less durable if molded from polymers. Zinc casting alloys also offer precise casting tolerances at moderate temperatures, making it an ideal material choice for both the open face, open top hexahedral box and the detachable frame of the gallery pendant. High strength Zinc alloys are also ductile, allowing for flat sheet pattern casts that can be crimped to form a structural open face, open top hexahedral box 12 with outward oppositely extending side flanges 17 and latch tabs 19 extending from the open face edge of the bottom side 21 of the formed box 12. The detachable face frame 13 may also be precision cast from such high strength Zinc alloys with opposing side shoulders 23 and flange channels 26 that can be easily worked, post casting for easily receiving the side flanges 17 of the hexahedral box 12.

It should be recognized that skilled pendant designers can specify different configurations for gallery pendant that performs substantially the same function, in substantially the same way, to achieve substantially the same result as those components described and specified in this application. Similarly, the respective elements described for effecting the desired functionality for a gallery pendant may be configured differently, per constraints imposed by different mechanical and material systems, yet provide substantially the same functionality, in substantially the same way to achieve substantially the same result as those components described and specified by the Applicant. Accordingly, while mechanical components suitable for implementing the describe gallery pendant for may not be exactly as described herein, they may fall within the spirit and the scope of invention as described and set forth in the appended claims.

I claim:

1. A gallery pendant for displaying an article comprising, in combination, a) a hexahedral box having a back, a bottom side, an open face, an open top, and sides with ear loops proximate the open top;

b) a face frame having a front display surface and a back surface dimensionally larger than the open face of the hexahedral box framing an opening dimensionally smaller than the open face of the box;

c) means for positioning the face frame on, securing the face frame to and detaching the face frame from the open face of the box, and d) a suspension cord or chain received through the ear loops;

whereby the article placed into the hexahedral box is confined within the box by the face frame and the cord or chain received through the ear loops and is viewed through the opening of the face frame.

2. The gallery pendant of claim 1 wherein the means for positioning the face frame on, securing the face frame to, and detaching the face frame from the open face of the box comprise, in combination:

e) side flanges oppositely extending outwardly from the sides of the hexahedral box;

f) parallel side shoulders extending up from central sections on opposite sides of the back surface of the face frame providing opposing flange channels opening inward, sized and spaced for easily receiving the side flanges extending outwardly from the sides of the hexahedral box;

g) a latch tab on the bottom side of the hexahedral box extending out from the open face of the hexahedral box, and h) a latch recess penetrating into the back surface of the face frame positioned and sized for receiving the latch tab extending out from the open face of the hexahedral box;

wherein the face frame and the side flanges of the hexahedral box elastically flex for allowing the latch tab to slide onto the back surface of the face frame and snap into the latch recess as the face frame, receiving the side flanges of the hexahedral box in its flange channels, is slid downward over the open face of the hexahedral box, and for allowing the latch tab to be lifted out of the latch recess onto the back surface of the face frame enabling the face frame to slide upward over and off the open face of the hexahedral box.

3. The gallery pendant of claim 2 wherein top ends of the opposing flange channels receiving the side flanges of the hexahedral box provided by the parallel side shoulders extending up from the central sections and the opposite sides of the back surface of the face frame are closed for limiting downward translation of the face frame relative to the hexahedral box.

4. The gallery pendant of claim 3 wherein the face frame is precision cast from Zinc alloys.

5. The gallery pendant of claim 2 wherein the face frame has a bottom frame member with a perimeter edge having a ramp cut into the perimeter edge that extends up from the perimeter edge onto the back surface of the face frame that is located and sized to register with, receive and engage the latch tab for elastically lifting the bottom frame member of the face frame over the latch tab as the face frame is slid downward over the open face of the hexahedral box.

6. The gallery pendant of claim 5 further including a second latch tab on the bottom side of the hexahedral box extending out from the open face of the hexahedral box, a second latch recess penetrating into the back surface of the face frame positioned and sized for receiving the second latch tab extending out from the open face of the hexahedral box, and a second ramp cut into the perimeter edge that extends up from the perimeter edge onto the back surface of the face frame that is located and sized to register with, receive and engage the second latch tab.

7. The gallery pendant of claim 2 wherein the hexahedral box, the side flanges and the latch tab are formed from a flat sheet pattern cast of a ductile metal alloy.

8. The gallery pendant of claim 1 wherein the opening of the face frame is square.

9. The gallery pendant of claim 1 wherein the opening of the face frame is circular.

10. The gallery pendant of claim 1 wherein the hexahedral box and the opening of the face frame are rectangular.

11. The gallery pendant of claim 1 wherein the hexahedral box is rectangular and the opening of the face frame is oval.

12. The gallery pendant of claim 1 wherein the opening of the face frame is curvilinear.

13. The gallery pendant of claim 1 wherein the opening of the face frame is rectilinear.

14. The gallery pendant of claim 1 wherein the opening of the face frame is a lattice with curvilinear openings.

15. The gallery pendant of claim 1 wherein the opening of the face frame is a lattice with rectilinear openings.

16. The gallery pendant of claim 1 wherein the opening of the face frame is a regular array of small curvilinear and rectilinear openings.

17. The gallery pendant of claim 1 wherein the opening of the face frame is an irregular array of small curvilinear and rectilinear openings.

18. A set of gallery pendants for displaying artistic and craft articles comprising, in combination;

a) a plurality of hexahedral boxes of different depths each having an open top, identical open faces, a back, a bottom, and two sides each with an ear loop proximate the open top of the box;

b) a plurality of face frames dimensionally larger than the open faces of the hexahedral boxes framing different openings dimensionally smaller than the open faces of the boxes;

c) means for positioning each particular face frame on, securing each particular face frame to and detaching each particular face frame from the open face of each box, and d) a suspension cord or chain received through the ear loops through the sides proximate the open top of the particular box;

whereby the hexahedral boxes and the face frames are interchangeable for allowing the articles to be confined within a particular hexahedral box by a particular face frame and the cord or chain, and be viewed through the opening of the particular face frame.

* * * * *